US007207465B2

(12) United States Patent
Weist

(10) Patent No.: US 7,207,465 B2
(45) Date of Patent: Apr. 24, 2007

(54) SELF-OPENING CLOSURE FOR COMPOSITE PACKAGINGS OR FOR CONTAINER CONNECTION PIECES CLOSED BY FILM MATERIAL

(75) Inventor: Mario Weist, Stuhlingen (DE)

(73) Assignee: SIG Technology Ltd., Neuhausen am Rheinfall (CH)

( * ) Notice: Subject to any disclaimer, the term of this patent is extended or adjusted under 35 U.S.C. 154(b) by 148 days.

(21) Appl. No.: 10/516,444

(22) PCT Filed: May 22, 2003

(86) PCT No.: PCT/CH03/00328

§ 371 (c)(1),
(2), (4) Date: Jan. 21, 2005

(87) PCT Pub. No.: WO03/101843

PCT Pub. Date: Dec. 11, 2003

(65) Prior Publication Data

US 2005/0242113 A1 Nov. 3, 2005

(30) Foreign Application Priority Data

May 31, 2002 (CH) ..... 0917/02

(51) Int. Cl.
*B67D 5/00* (2006.01)

(52) U.S. Cl. ..... 222/83

(58) Field of Classification Search ..... 222/83
See application file for complete search history.

(56) References Cited

U.S. PATENT DOCUMENTS 5,020,690 A * 6/1991 Kishikawa et al. ..... 222/83
5,147,070 A * 9/1992 Iwamoto ..... 222/83
5,482,176 A * 1/1996 Maietta et al. ..... 222/83
5,947,318 A * 9/1999 Palm ..... 222/83
6,364,164 B1 * 4/2002 Troiano ..... 222/83
6,382,462 B1 * 5/2002 Ostergaard-Nielsen et al. .. 222/83
6,851,576 B2 * 2/2005 Dubach ..... 222/83

FOREIGN PATENT DOCUMENTS

EP 1088764 A1 4/2001
WO WO 95/05996 3/1995

* cited by examiner

*Primary Examiner*—Philippe Derakshani
(74) *Attorney, Agent, or Firm*—Edwin D. Schindler

(57) ABSTRACT

The self-opener closure comprises a spout (2) having a projecting lower rim (9) which is to be molded or glued to a composite packaging, an associated rotary cap (1) as well as a self-opener sleeve (3) arranged within the spout (2). This self-opener sleeve (3) can be made to rotate by the rotary cap (1). The inner side of the spout (2) is provided with four guide webs having varying inclines arranged over its inner circumference. These interact with specially formed guide ribs at the outer wall of the self-opener sleeve (3), which brings about that the self-opener sleeve (3), when continuously rotated in the inside of the spout (2), and by being guided at these guide ribs, describes an uneven downwardly directed movement, which superposes its rotational movement. Thus, the self-opener sleeve (3) first pierces the paper or cardboard laminate with the tip (24) of its lancing mandrel in a steep, screwline downwardly directed movement, and thereafter completes a horizontal rotational movement about 340°, whilst it cuts a circular disk out of the laminate with its sharp cutting edge, and thereafter pivots this downwards and retains it in this position.

20 Claims, 7 Drawing Sheets

Figure 1:
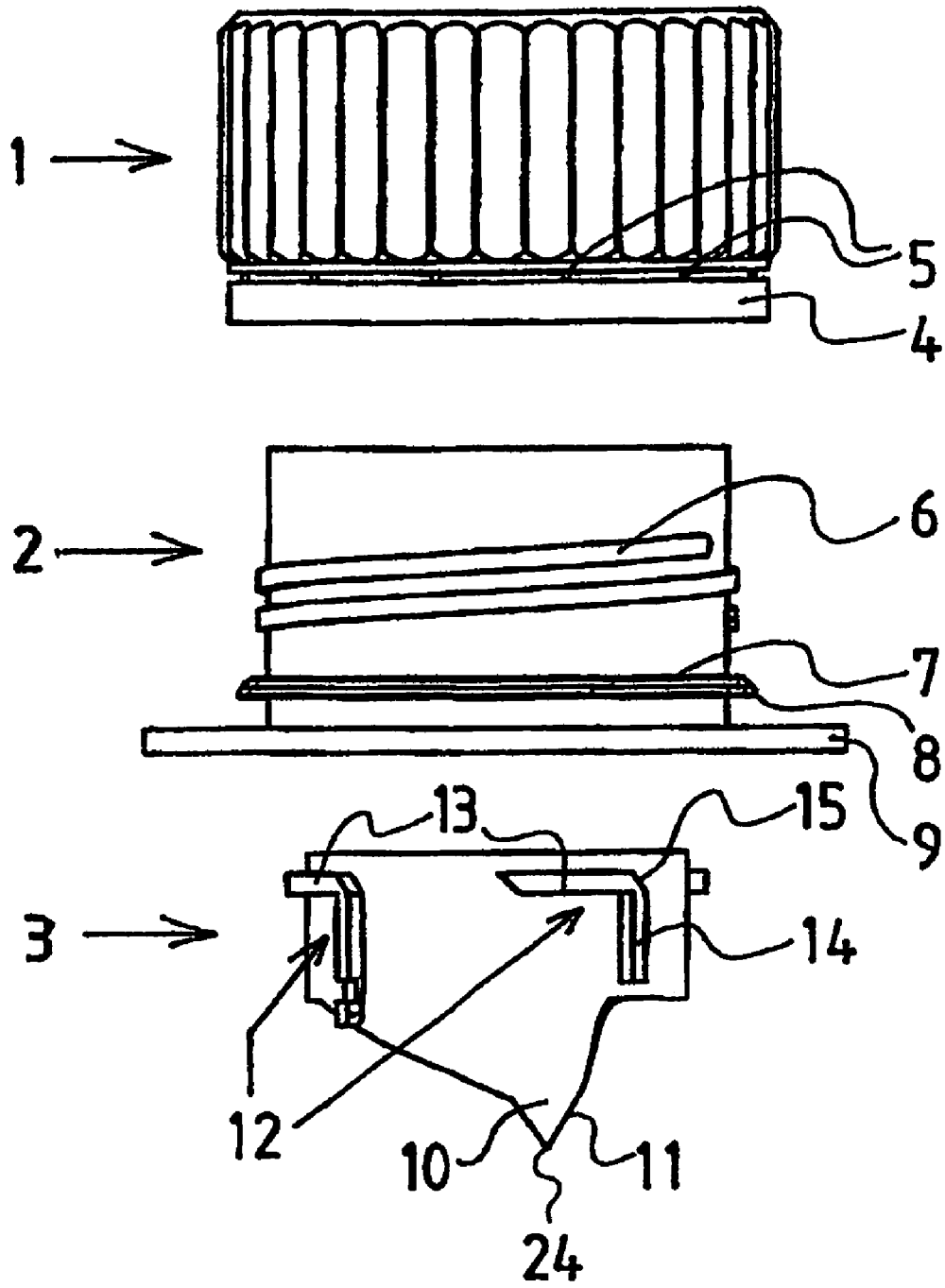

SELF-OPENING CLOSURE FOR COMPOSITE PACKAGINGS OR FOR CONTAINER CONNECTION PIECES CLOSED BY FILM MATERIAL

BACKGROUND OF THE INVENTION

The present invention relates to a self-opener closure for composite packagings as well as to container spouts or bottle spouts of all types to be closed with film material. At the same time one specifically envisages liquid packagings in the form of such composite packagings of film-coated paper in which, for example, milk, fruit juices, all types of non-alcoholic beverages or generally liquids also in the non-food range are packaged. The closure may however also be applied to composite packagings in which goods capable of being poured such as sugar, semolina or all types of chemicals and likewise are kept or packaged. With this film-coated paper it is the case of a laminate material such as a paper or cardboard web coated with plastic such as, for example, polyethylene and/or aluminium. Usually the volumes of such packagings range from 20 cl up to 2 liters and more. Alternatively the self-opener closure may also be assembled on containers which are closed by film material, such as on all types of bottles made of glass or plastic or on similar containers. Such closures of plastic are known in various embodiments. If they are envisaged for a composite packaging, they essentially form a pour-out or discharge spout having a rim which radially projects from its lower edge and which forms a closing flange at this discharge spout. The spout is equipped with an outer thread onto which a rotary cap may be screwed as a closure. Such a self-opener closure is flanged onto the composite packaging in that it is sealingly welded onto the composite packaging with the lower side of its projecting edge, thus with the lower side of its flange. However, the free passage at the lower end of the spout is thereafter closed by paper and sealing film of the composite packaging. In the case of a bottle closure the pour-out spout for its part may be placed or screwed onto the opening of the bottle, and on its inner side is closed with a film membrane. The spout is equipped with an outer thread onto which the rotary cap may be screwed as a closure. To open, the film-reinforced paper passing through and below the welded-on spout, or the film membrane extending within the spout must be cut open or torn open towards the opening or pressed away so that the passage may be cleared and the fluid or the pourable material may be poured or shaken out of the container through the spout. For this a sleeve or a nipple is arranged within the spout which, on rotating the screwed-on cap, is caught by this and thus is rotated by this in the same direction of rotation. By means of a thread counter-rotating to the thread on the outer side of the spout and on the outer side of the sleeve, this sleeve moves continuously in a downward direction on screwing off the rotary cap, that is to say when said sleeve is displaced upwards with respect to the liquid packaging. The lower rim of the sleeve is provided with one or more tearing or cutting teeth. In this way, and as a result of its rotation and constant downwards movement, the sleeve is to press or cut a disk out of the film-reinforced paper or film membrane which runs beneath it.

However, such conventional self-opener closures do not function satisfactorily. The disks are not cut cleanly from the paper film or the film membrane, but rather the sleeves simply press a piece of film out of this. The remaining edge is frayed and thus shreds of paper or film project into the passage which was supposed to be cleared. These shreds often project downwards into the container and on pouring or shaking out possibly block the path of the air flowing from outside into the container, or the even project into the path of the outflowing jet of liquid or the poured product. With larger packagings having stronger film-reinforced paper or cardboard the opening procedure is carried out even less reliably and cleanly. The sleeve moving slowly downwards and rotating at the same time, with its complete lower edge quasi simultaneously contacts the film-reinforced paper web which is to be cut open and as a whole presses it downwards and rotates on it until a hole is scraped open or broken through rather than cleanly cut open. One problem lies in the fact that the film to be cut open gives way slightly to the pressure of the sleeve acting to a certain extent as a drill bit, and thus the sleeve no longer acts on a paper film which is plane but on one which is curved downwards. Furthermore, the previous solutions demand a significant force on the part of the user as a result of the design of the sleeves, which are aptly also called penetrators, because indeed they penetrate a piece of paper film rather than cleanly cutting a circular disk out of it. That is to say, a large torque must be exerted since the teeth or tearers on the lower penetrator edge or sleeve edge firstly merely scratch the film and then they must overcome a large resistance to rotation. In the uppermost layer of the paper thickness they act similarly to tear-open teeth, specifically in a scraping, pressing and tearing manner, rather than acting as actual cutting blades. In order to facilitate the breaking out or tearing out for conventional self-opener closures of this type, the film material or the composite material is pre-weakened at the desired tear locations by means of lasers or punching tools. However, this pre-weakening entails much technological effort. Expensive installations are required and the handling for the machining of the penetration locations on the films is time-consuming. In spite of these elaborate weakening measures, the conventional self-opener closures do not cut cleanly, but tear the paper or plastic film rather than cleanly cutting it open, which explains the large resistance to rotation. On account of these large rotation resistances, even breakages of the means which should effect the transmission of the torque from the threaded cap to the penetrator sleeve occur, or the catching cams provided to engage into grooves on the penetrator sleeve can jump out of these grooves. If this happens, the self-opener closure is no longer capable of functioning.

SUMMARY OF THE INVENTION

It is therefore an object of the present invention to solve these problems and to provide a self-opener closure for composite packagings or for container spouts sealed with film material, which reliably permits to cut-out the laminate disk or film disk in various dimensions in the clear spout passage and to obtain cleanly cut edges so that shreds projecting into the passage are avoided. For a multitude of film materials and composite materials it should even be possible to dispense with the targeted pre-weakening of the cutting locations by punching or laser treatment.

This object is achieved by a self-opener closure for composite packagings as well as for container spouts closed with film material, consisting of a spout which may be sealingly fitted onto a composite packaging or onto a container closed with film material, of an associated rotary cap, as well as of a self-opener arranged within the spout and which self-opener may be brought into rotation by the rotary cap. The self-opener closure is characterised in that the inner side of the spout is provided with at least two guide webs being arranged around its inner circumference and having varying inclines, so that the sleeve-shaped self-opener, at whose outer side there are arranged at least two guide ribs each having a guide surface, and when continuously rotating within the spout guiding its guide surfaces at the guide webs, initially follows a downwardly directed movement, along a steep screw-path which hereafter goes over into a pure horizontal rotational movement.

BRIEF DESCRIPTION OF THE DRAWING FIGURES

Figure 2:
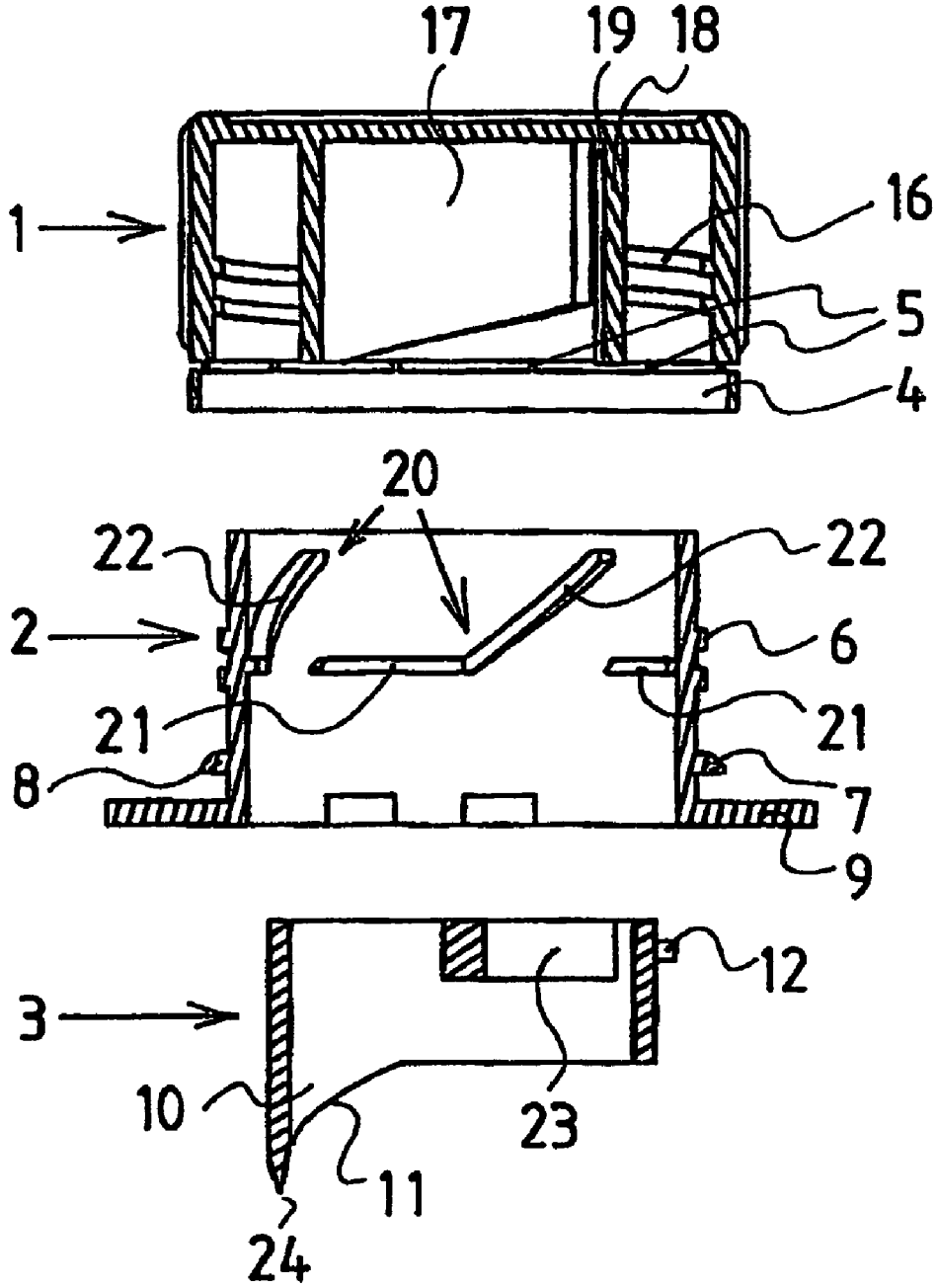
Figure 3:
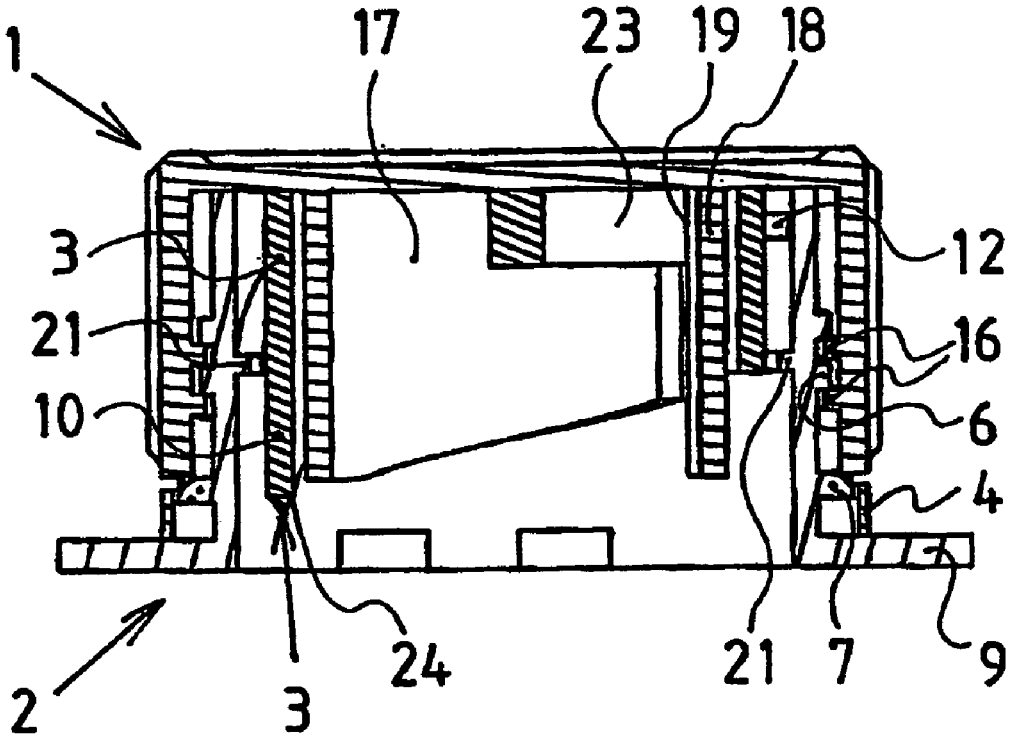
Figure 4:
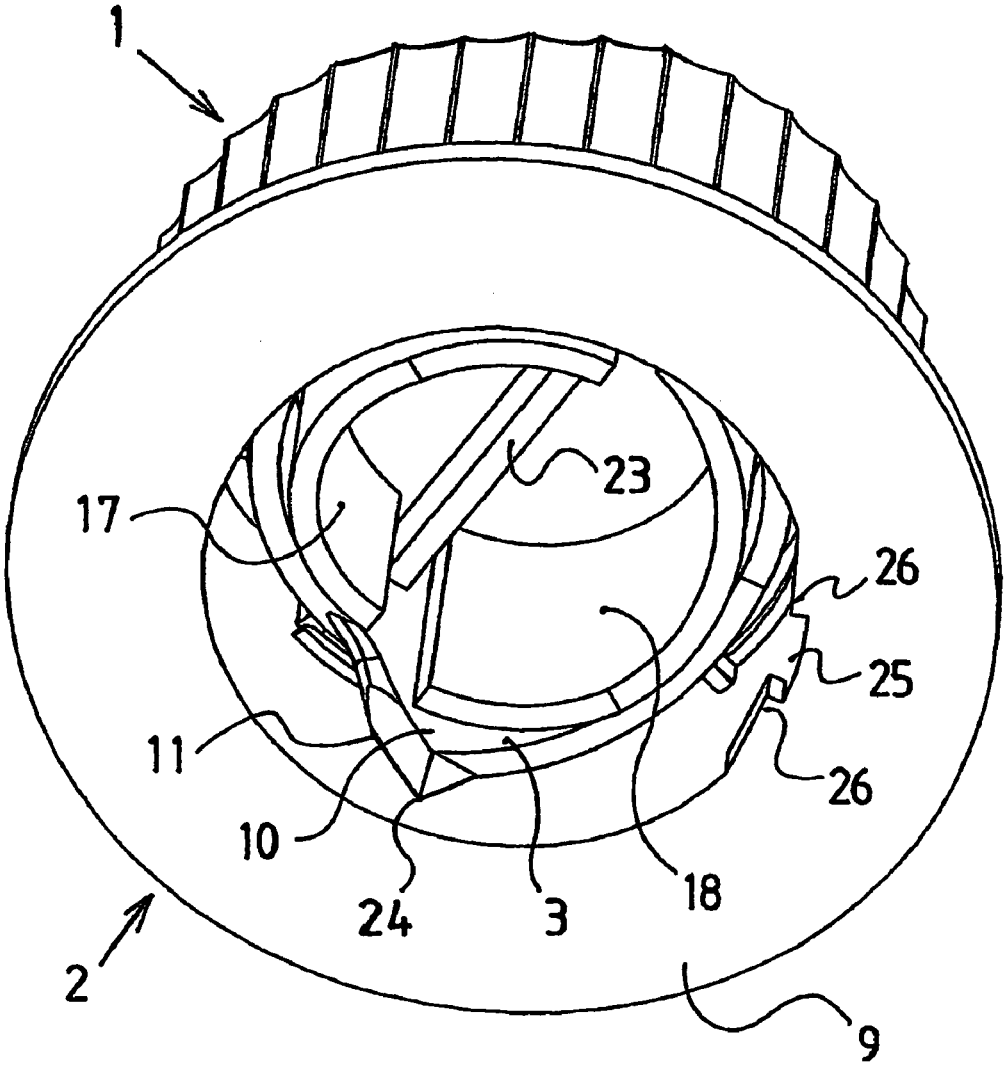
Figure 5:
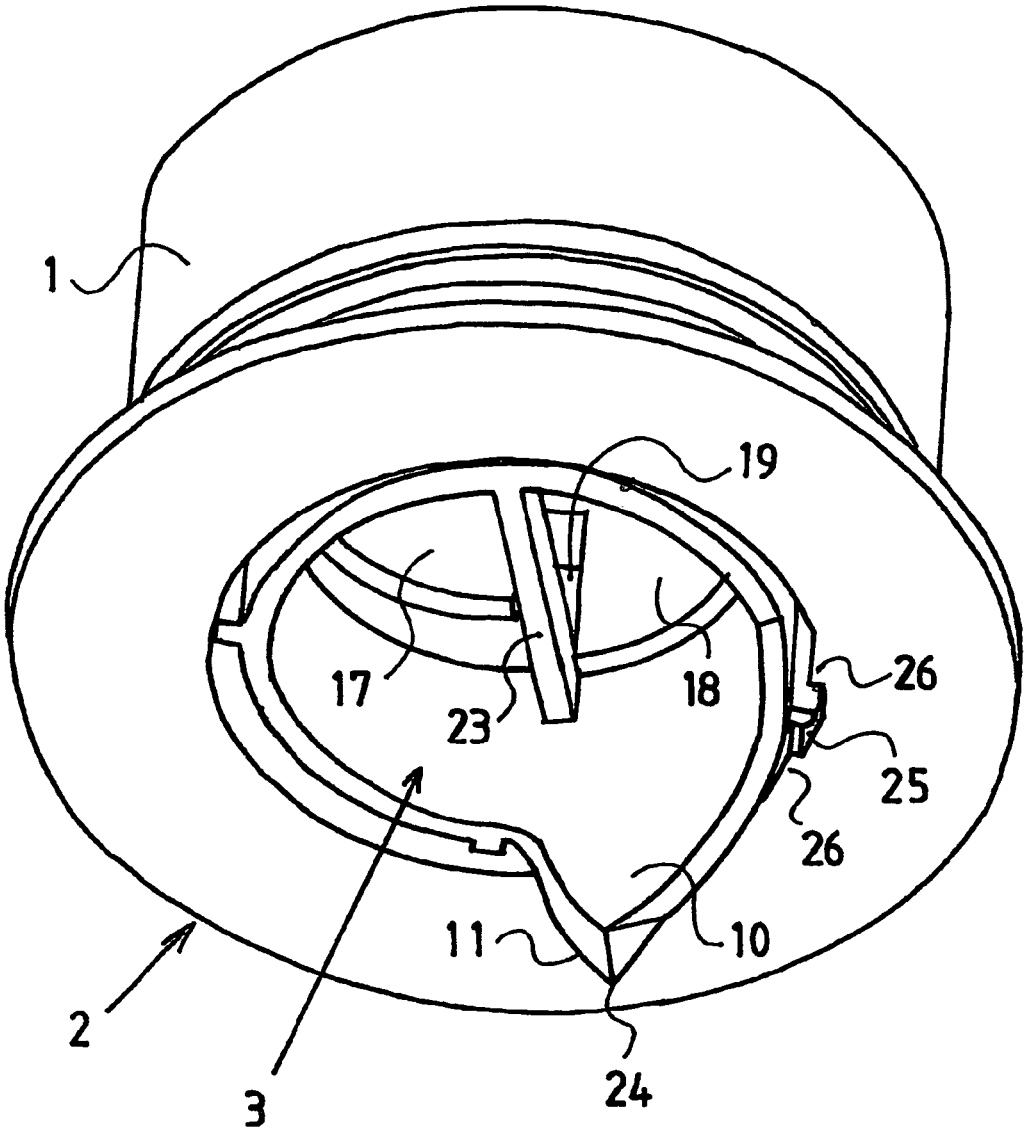
Figure 6:
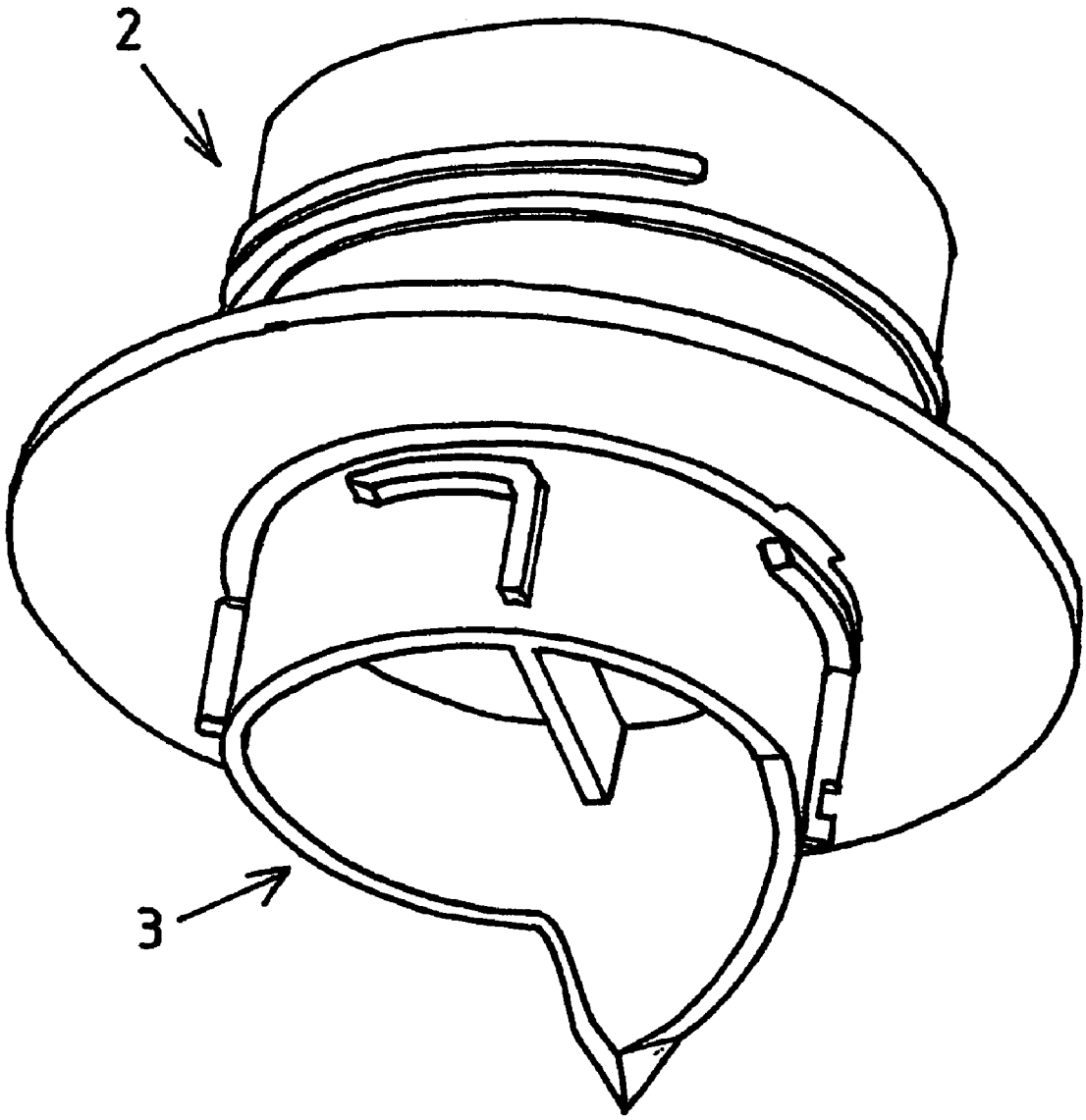

The Figures show various views of a preferred embodiment of this self-opener closure for composite packagings. By means of these Figures the self-opener closure shall be described in detail and its function shall be explained. There are shown in:

FIG. 1 the self-opener closure with its three components in a dismantled state, in a side view;

FIG. 2 the self-opener closure with its three components in a dismantled state, in a side view, whereby all components are shown in a longitudinal sectional view along the centerline of the closure;

FIG. 3 the self-opener closure with its three components in an assembled state in a longitudinal sectional view along the centerline of the closure;

FIG. 4 the self-opener closure in an assembled state in a perspective view as seen from below at an angle, whereby the self-opener sleeve is in its initial state;

FIG. 5 the self-opener closure in an assembled state in a perspective view as seen from below at an angle, whereby the self-opener sleeve is in an extended or lowered state ready for the cutting movement;

FIG. 6 the self-opener closure in an assembled state in a perspective view as seen from below at an angle, whereby the self-opener sleeve is shown to be completely removed from the spout; and FIG. 7 the self-opener closure in an embodiment for assembling on a container closed with a film.

DETAILED DESCRIPTION OF THE DRAWING FIGURES

FIG. 1 shows the self-opener closure in a dismantled state. It consists of three components made of injection moulded plastic, namely a rotary cap 1, a discharge spout 2 and a self-opener sleeve 3. The rotary cap 1 is provided on its outer surface with knurls or grooves for ease of handling. A guarantee strip 4 is injection moulded to the lower edge of the rotary cap 1 and is connected to the rotary cap 1 only by thin material bridges or bars 5 being designed as and arranged to be predetermined breaking points. At its outer side the discharge spout 2 is provided with an outer thread which fits to an equivalent inner thread on the rotary cap 1, whereby this is not visible here. Beneath the outer thread 6 the spout 2 has a small, obliquely angled bead 7 with an angular or square-edged rim 8 on its lower side. Alternatively, instead of a discharge spout 2 having an outer thread and an appropriate threaded cap having an inner thread, a discharge spout having an appropriate cap can be foreseen, whereby the rotary cap can be mounted onto the discharge spout by means of a bayonet coupling. For this, the spout is provided on its outer side with appropriate grooves and the rotary cap is provided on its inner side with equivalent cams, or vice versa. The counter-clockwise rotation of the rotary cap, which is to be carried out initially in a horizontal plane, firstly activates the self-opener sleeve exactly in the same way as usually the threaded cap is activated, which shall be more closely described hereinafter. A radially projecting, annular and planar projection or brim 9 is formed at the lower edge or rim of the spout 2. With the lower surface of this planar projection, the spout 2 is sealingly welded onto a composite packaging made of a laminate composed of a film-reinforced paper or cardboard web. Therefore, this laminate extends continuously beneath the discharge spout 2 and, on its underside, seals the clear passage opening of the spout 2. In order to be able to pour liquid through this spout out of the packaging, the laminate in the region of the passage opening must be pressed away, perforated, cut away or tom away. It is desirable to uncover the passage opening as completely as possible, which means that the laminate in this area is cut away as cleanly as possible, after which the cut laminate disk can be pivoted away, thus clearing the passage as completely as possible. A self-opener in the form of a specially formed sleeve 3 serves to uncover the passage opening. At the lower edge of this sleeve 3 there is provided at least one lancing mandrel 10 having a sharp tip 24, which, when viewed from above onto the sleeve 3, forms a sharp cutting edge 11 in a counterclockwise direction. At the outer circumference of the self-opener sleeve 3 there are provided at least two guide ribs 12 distributed over the circumference, and preferably, as shown in the embodiment, four guide ribs are provided. Each of these guide ribs 12 is composed of two sections 13, 14, namely a section 13 extending horizontally at the sleeve 3 and a vertical section 14, which together form a right angle. The outer tip of this right angle is bevelled at an angle of 45° to the sections 13, 14 and this bevelled surface forms a guide surface 15, which is intended to glide along a guide curve formed of guide webs at the inner wall of the spout 2, as shall be more clearly shown in further Figures.

In FIG. 2 there is shown the self-opener closure also with its three components, that is to say the rotary cap 1, the discharge spout 2 and the self-opener sleeve 3 in a dismantled state. However, all components are shown in a longitudinal section along the centreline of the closure. Inside the rotary cap 1 the inner thread 16 can be seen. At the lower edge, the guarantee strip 4 is seen attached by several thin material bridges or bars 5 serving as predetermined breaking points. As a feature, within this rotary cap 1 at the underside of the cap lid in the shown embodiment, there are formed two cylinder wall segments 17, 18, whereas the radius of the corresponding cylinder is smaller than that of the cylindrically shaped rotary cap wall. Both cylinder wall segments 17, 18, which follow each other in the circumferential direction, are spaced from each other by a small lateral space, so that a slit 19 is formed between each of them. The lower edges of the two cylinder wall segments 17, 18 are designed to slope downwards and thus each form a lower edge leading downwardly directed in a screwline shape. At the discharge spout 2 shown beneath the rotary cap 1, guide webs 20 are arranged in distribution over the inner circumferential wall of the spout 2, which guide webs are to cooperate or interact with the guide ribs 12 of the self-opener sleeve 3. In the embodiment shown there are four such guide webs 20; one is shown in full, the two on the left and the right of the Figure are shown each in half, and the one arranged at the portion of the spout 2 which has been cut away for this illustration is not visible at all. Each of these guide webs 20 consists of a horizontal section 21 and a section 22 which inclines or slants upwards towards the axis of the spout. At the outer side of the spout 2 the grooves of the outer thread 6 and the bead 7 can be seen, over which the rotary cap 1, for assembling with its guarantee strip 4, can be irreversibly drawn or pushed. Because the upper side of the bead 7 is inclined, the guarantee strip 4 can be pushed down over this bead 7 under slight deformation. In contrast, and because of the sharp edge or rim 8 at the lower side of the bead 7, the guarantee strip 4 cannot be pulled back upwards over the bead 7 once it has tightly enclosed the circumferential wall of the spout 2 below this bead. Therefore, in order to open the rotary cap 1, the guarantee strip 4 must be removed by tearing it away, thus rupturing the material bridges 5. This releases the rotary cap 1 to be turned and moved upwards. The projection 9 projecting radially from the lower rim of the spout 2 is welded to the paper laminate or cardboard laminate of a packaging for liquids or dry goods by means of ultrasonic welding. The self-opener sleeve 3 is shown beneath the spout 2. The lower edge of the sleeve 3 tapers off in a guide mandrel 10, which, when viewed from above towards the side in counter-clockwise direction, forms a sharp cutting edge 11 and tapers off at the end in a sharp tip 24. To the right of FIG. 2 one sees the horizontally extending section 13 of an individual guide rib 12 at the outer wall of the sleeve 3. At the inner side close to the upper edge of the self-opener sleeve 3 a web or bridge 23 traverses the clear distance of the sleeve 3. When the components of this self-opener closure are assembled, the self-opener sleeve 3 is arranged within the spout 2. In doing so, the sleeve 3 is rotationally pushed into the spout 2 in such a manner that the guide ribs 12 of its bevelled guide surface 15 come to rest at the underside of the upper end of the inclined or slanting section 22 of the guide webs 20 at the spout 2. In turn, the rotary cap 1 is mounted in such a rotational position onto these two components that the traversing web 23 is arranged in the slits 19 between the two cylinder wall segments 17, 18 at the lower lid side of the rotary cap 1. Under slight deformation of its guarantee strip 4, the rotary cap 1 is pushed with force over the upper taper of the bead 7 and thus secures the rotary cap 1 from twisting by subsequently closely fitting to the outer side of the spout wall, because it is retained in its lowest screw position by the guarantee band 4 and can only be unscrewed if the guarantee band 4 is first tom away, because this can no longer glide over the sharp lower edge 8 of the bead 7.

FIG. 3 shows the self-opener closure with its three components in an assembled state in a longitudinal section along the centreline of the closure. One sees that the self-opener closure 3 lies between the cylinder wall segments 17, 18 and the spout 2, and that the traversing web 23 extends at the upper edge of the sleeve 3 in the slit 19 between the neighbouring cylinder wall segments 17, 18. At the outer side of the sleeve 3 one sees the horizontal section 13 of one of its guide ribs 12. On the inner side of the spout 2 one sees the horizontal sections 21 of the guide webs 20, and at the outer side of the spout 2 the ribs of the outer thread 6 and, a little further down, the bead 7 over which the guarantee band 4 is pushed, as well as the radial projection 9 at the lower edge or rim of the spout 2. At the inner side of the rotary cap I its inner thread 16 can be seen, and at the lower edge of the rotary cap 1 the guarantee band 4 connected by fine material bridges 5. In this embodiment, the self-opener closure 3 is in its initial state, that means it is completely drawn back into the rotary cap 1.

There now follows a description of how the components 1, 2 and 3 of this self-opener closure interact when opening the closure and thereby cutting open the paper or cardboard laminate which is welded onto the spout 2. Firstly, the guarantee band 4 is torn away. This releases the rotary cap 1 for unscrewing in that it can move upwards along the spout 2. The lateral limiting surfaces of the cylinder wall segments 17 and 18 now act upon the traversing web 23 at the self-opener closure, that means they entrain it and thus cause it to rotate in the direction of unscrewing the rotary cap 1 when viewed from above, that means in a counter-clockwise direction. In an alternative embodiment, instead of a single traversing web there can be provided a star-shaped web having three arms or webs distributed radially around the circumference from the center of the sleeve 3 and projecting outwards; in this case, suitable cylinder wall segments must be foreseen, between which the three webs come to lie. Also four radial webs which together form a cross made of two webs traversing the sleeve diameter are possible, whereas then four cylinder wall segments are distributed around the circumference. When the sleeve 3 now is brought into rotation in a counter-clockwise direction via its web 23, then the guide surfaces 15 of its guide ribs 12, as seen in FIGS. 1 and 2 but not visible here, glide along the underside of the guide webs 20 in a downward direction at the spout 2. Rotation of the rotary cap I to the left is thus accompanied by a steep, screwline downwardly directed movement of the self-opener closure 3. As a result of this steep downward movement, the paper or cardboard laminate which extends over the clear breadth of the spout 2 is initially essentially perforated or pierced by the sharp tip 24 of the lancing mandrel at the lower edge of the sleeve 3. Thus, only a hole is pierced into the edge of the laminate disk, that means that the laminate is pierced and not cut. Seen microscopically, when pierced the laminate material is displaced to all sides and is torn at the piercing point. The reaction forces of the piercing movement are brought about via the welding by the projecting brim 9 of the spout 2. This first movement step of the self-opener closure is decisive. Due to the fact that in conventional solutions the self-opener sleeve continuously rotates downwardly directed in a screwline and its teeth thus impinge upon the film at a flat angle, they are not able to pierce the film. However, with the present solution, in a first phase the sleeve experiences a very steep downwardly directed movement. The sharp tip 24 of its lancing mandrel 10 thus impinges on the film at a steep angle and pierces it initially virtually locally. By the time the paper or cardboard or plastic film has been pierced, the sleeve 3 has reached its lowest position in relation to the spout 2, that means that the guide surface 15 at its guide ribs 12 is now positioned at the end of the inclined guide webs 22 at the inner wall of the spout, or at the beginning of the horizontal sections 21 of the guide webs. If the rotary cap 1 is further turned in a counter-clockwise direction, then also the sleeve 3 is turned further in a counter-clockwise direction but no longer moves downwards, but rotates in a horizontal plane. Now the lancing mandrel 10 protruding through the paper or cardboard film acts as a knife with its sharp cutting edge 11. Thus the cutting edge 11 cuts out a circular disk out of the paper or cardboard laminate along the lower inner edge of the spout 2. The cutting movements extend over one rotation of the sleeve of about 340°. At the finish of the cutting rotation, the cut out disk is suspended merely by a thin material bridge and, by means of the pressure force of the cutting edge 11 acting in the cutting direction, is pivoted or is folded downwards into the packaging and is retained in this downwardly pivoted position. Thus, in principle, this self-opener closure functions like a classic can opener. Also when opening a can it is decisive that the lid is first pierced by an essentially vertical movement of the tip of the cutting tool upon and through the can lid. Only when the can lid has been pierced by the tip of the cutting tool does there follow a separate, now horizontally directed cutting movement of the culling tool. The present self-opener closure achieves precisely this can-opener effect, in that the sleeve moves first of all steeply downwards and in a first phase merely pierces the film with the tip 24 of the lancing mandrel 10, and thereafter in a second phase, the lancing mandrel 10 with its cutting edge 11 acts as a cutting tool in that the sleeve is rotated horizontally. Therefore, an essential feature is that the movement of the sleeve is discontinous or erratic. After a steep downwardly directed movement for piercing the film there follows a discontinuous point and then a horizontal rotational movement for cutting. Piercing and cutting are distinctly different, such as in opening a metal can with a can opener. At the lower edge of the inner side of the spout 2 there is a recess 25 which is bordered or framed by ramps 26. During the end phase of the rotational movement of the sleeve 3, a horizontal section 21 enables one of its guide ribs 2 to glide over the ramp 26 and engage into this recess 25. Thereafter the sleeve 3 can be neither rotated further forwards nor backwards, so that after cutting out and pivoting away of the laminate disk, the sleeve is held in this position. In this manner the laminate disk which has been almost totally cut away is reliably retained pivoted downwards in the liquid packaging. Until the entire cutting movement, that is the rotation of the sleeve 3 about 340° after piercing of the paper or cardboard laminate, has been completed, the rotary cap 1 at the spout 2 is screwed upwards for such a distance that the cylinder wall segments 17, 18 projecting downwards at the underside of the rotary cap lid are lifted over the web 23 at the sleeve 3 and thus cannot transmit any torque to the web 23. Thereafter, the rotary cap 1 is completely unscrewed from the spout 2 and the liquid can now exit the liquid packaging via the uncovered spout 2 or, in the case of dry goods, can be poured out through the spout 2. Now the rotary cap 1 can again be screwed onto the spout 2 to re-seal the closure. When the rotary cap 1 is again screwed on to close the closure, the screwline shaped, downwards extending lower edges of the cylinder wall segments 17, 18 effect that no torque in a clockwise direction is transmitted to the web 23, in that these screwline shaped lower edges merely glide over the upper side of the traversing web 23, but can no longer entrain it.

FIGS. 4 and 5 illustrate the mode of operation of this self-opener closure particularly well. FIG. 4 shows the self-opener closure in an assembled state in a perspective view as seen from below at an angle. The self-opener closure 3 is in its initial state. At its upper edge one sees a portion of the traversing web 23 which connects its upper edge at two points. This web 23 lies between the two cylinder wall segments 17, 18 which are moulded to the underside of the lid of the rotary cap 1. When the rotary cap 1 is rotated in a loosening direction, in this case as seen from below in a clockwise direction, then the cylinder wall segments 17, 18 entrain the web 23 lying there between and thus also the sleeve 3, and, due to the special guide ribs 12 at its outer side and the guide webs 20 at the inner side of the spout, compelling the sleeve to be moved in a downward direction in a steep spiral. In doing so, the sharp tip 24 of the lancing mandrel 10 acts as a piercing tip and first pierces the paper or cardboard laminate welded onto the underside of the projecting brim 9 of the spout 2 of the composite packaging.

In FIG. 5 there is shown the self-opener closure with the self-opener sleeve in an extended or completely lowered state. Having reached this position, the sleeve 3 may rotate further only in a horizontal plane, whereby the lancing mandrel 10 now acts as a knife, because its edge, here seen from below and oriented in a clockwise direction, is formed as a sharp cutting edge 11. When the rotary cap 1 is further rotated by 340°, this cutting edge moves along the lower inner edge of the spout 2, thereby cutting a circular disk out of the paper or cardboard laminate which is welded to the underside of the projection 9, but is not shown here. As soon as the sleeve 3 has completed a rotation about 340° after having pierced the paper laminate, the end of one of the horizontal sections 13 of its guide ribs 12 engages in the recess 25 at the inner wall of the spout 2 and prevents the sleeve 3 from being able to be rotated further forwards or reversely. In this position the sleeve 3 has almost completely pivoted the disk which was cut away from the laminate downwards into the container and securely retains it in this position. The discharge through the spout 2 is thus enabled.

FIG. 6 shows the discharge spout 2 and the sleeve 3 of the self-opener closure in an assembled state in a perspective view as seen from below at an angle, whereby the self-opener sleeve 3 is shown to be completely disengaged from the spout 2, so that the special arrangement of its guide ribs 12 can be seen more clearly and thus its function can be better understood.

Figure 7:
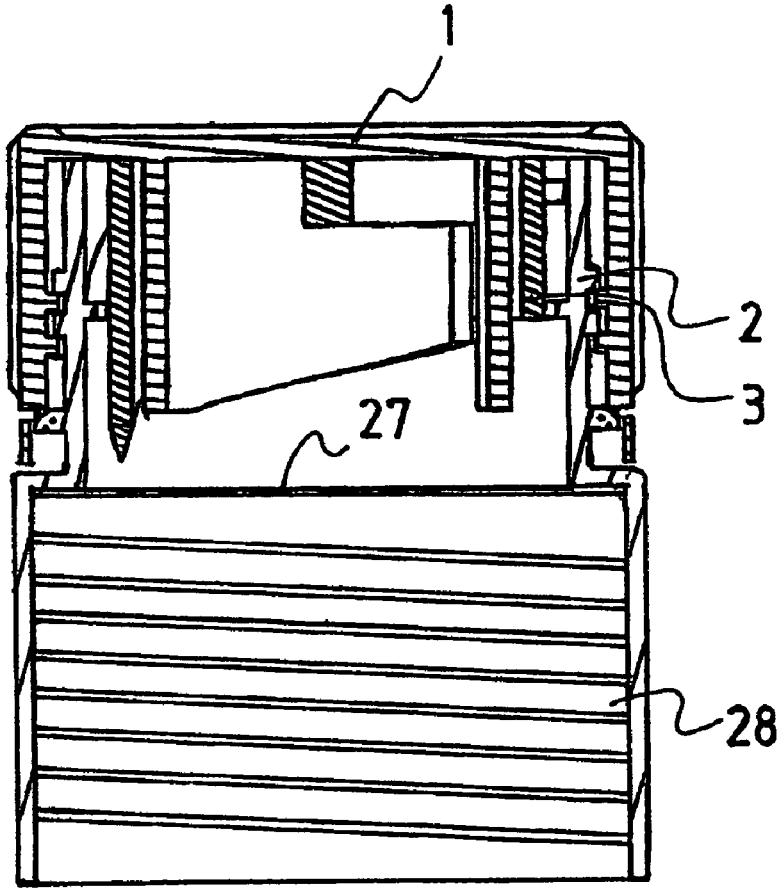

FIG. 7 shows an alternative embodiment of this self-opener closure for assembling on a membrane sealed neck of a container or a bottle. Therefore, the discharge spout 2 is not provided with a projecting rim at its underside, but is arranged over a shoulder 27 in a thread sleeve 28, which can be screwed on to the outer thread of a bottleneck or to the discharge spout of any type of container which is closed or sealed at its upper rim with a film.

The invention claimed is:

1. A self-opener closure for composite packagings for container spouts with a film material, comprising:

a spout mounted on a composite packaging or on a container spout sealed with a film material, said spout having an inner side with at least two guide webs around its inner circumference and having varying inclines;

a rotary cap having an inner side with at least two detached cylinder wall segments spaced apart from one another in a circumferential direction; and, a self-opener having a sleeve-shape with said rotary cap and said self-opener being arranged within said spout and being rotatable via said rotary cap, said self-opener having an outer side with at least two guide ribs on said outer side with each guide rib of said at least two guide ribs of said self-opener having a guide surface, so that when said self-opener rotates within said spout, said guide surface of said self-opener is guided by said at least two guide webs of said spout, thereby rotating said spout in a downwardly-directed movement along a screw-path, said self-opener further comprising at an inner side of an upper edge at least one web extending radially from a sleeve axis and traversing a diameter of said self-opener, said at least one web fitting between spaces of said at least two detached cylinder wall segments and walls of said spout, with said at least two guide ribs of said self-opener being arranged in distribution over a circumference of said outer side of said self-opener, said least two guide ribs cooperating with said at least two guide webs at said inner side of said spout in distribution over a circumference of said inner side of said spout, so that when said rotary cap rotates, torque of said rotary cap transmits over lateral limiting edges of said cylinder wall segments to a traversing web and to said self-opener, said at least two guide ribs being formed so that, when rotated, said self-opener initially follows a steep downwardly-directed screwline movement and subsequently assumes a purely rotational movement in a horizontal plane.

2. A self-opener closure for composite packagings for container spouts with a film material according to claim 1, wherein said self-opener comprises, at its lower edge, at least one lancing mandrel having a sharp, downwardly projecting tip and comprising a sharp edge at its flank showing in a counter-clockwise circumferential direction when viewed from above.

3. A self-opener closure for composite packagings for container spouts with a film material according to claim 1, wherein lower edges of said at least two detached cylinder wall segments each form a curved sloping in an axial direction relative to a cylinder of said three free-standing cylinder wall segments.

4. A self-opener closure for composite packagings for container spouts with a film material according to claim 1, wherein said at least two guide ribs of said self-opener at an outer wall of said self-opener are each comprised of a horizontal section and an adjoining vertical section, so that a tip of a right angle formed by said horizontal section and said adjoining vertical section is bevelled at an angle of 45° relative to an outer side of legs of said right angle, for forming a guide surface, and with said at least two guide webs of said spout each being comprised of a section extending with a constant inclination at a circumferential wall and an adjoining horizontal section.

5. A self-opener closure for composite packagings for container spouts with a film material according to claim 1, wherein said spout has a recess at a lower inner edge for receiving one guide rib of said self-opener of said at least two guide ribs in an end position of its rotational movement.

6. A self-opener closure for composite packagings for container spouts with a film material according to claim 1, wherein said at least two guide ribs of said self-opener comprises three continuous guide ribs distributed over a circumference of said self-opener, said three continuous guide ribs interacting with three guide webs of said at least two guide webs of said spout distributed over a circumference of said spout, so that when said rotary cap rotates, torque of said rotary cap transmits over lateral limiting edges of cylinder wall segments to a traversing web and to said self-opener with said three guide webs of said self-opener and said spout being formed, so that when rotated, said self-opener initially follows a steep downwardly-directed screw-line and subsequently assumes a purely rotational movement in a horizontal plane.

7. A self-opener closure for composite packagings for container spouts with a film material according to claim 1, wherein said at least two guide ribs of said self-opener comprises four continuous guide ribs distributed over a circumference of said self-opener, said four continuous guide ribs interacting with four guide webs of said at least two guide webs of said spout distributed over a circumference of said spout, so that when said rotary cap rotates, torque of said rotary cap transmits over lateral limiting edges of cylinder wall segments to a traversing web and to said self-opener with said four guide webs of said self-opener and said spout being formed, so that when rotated, said self-opener initially follows a steep downwardly-directed screwline and subsequently assumes a purely rotational movement in a horizontal plane.

8. A self-opener closure for composite packagings for container spouts with a film material according to claim 1, wherein said spout is a threaded spout and said rotary cap is a threaded rotary cap with a lower region of said threaded spout having a bead obliquely angled at an upper side thereof and at a lower side forms an angular rim, said threaded rotary cap having at a lower edge a guarantee strip molded thereto by material bridges having predetermined breaking points pushable over said bead.

9. A self-opener closure for composite packagings for container spouts with a film material according to claim 1, wherein said spout and said rotary cap form a bayonet coupling with a lower region of said spout having a bead obliquely angled at an upper side thereof and at a lower side forms an angular rim, said rotary cap having at a lower edge a guarantee strip molded thereto by material bridges having predetermined breaking points pushable over said bead.

10. A self-opener closure for composite packagings for container spouts with a film material, comprising:

a spout mounted on a composite packaging or on a container spout sealed with a film material, said spout having an inner side with at least two guide webs around its inner circumference and having varying inclines;

a rotary cap having an inner side comprising two detached cylinder wall segments spaced apart from one another in a circumferential direction; and, a self-opener having a sleeve-shape with said rotary cap and said self-opener being arranged within said spout and being rotatable via said rotary cap, said self-opener having an outer side with at least two guide ribs on said outer side with each guide rib of said at least two guide ribs of said self-opener having a guide surface, so that when said self-opener rotates within said spout, said guide surface of said self-opener is guided by said at least two guide webs of said spout, thereby rotating said spout in a downwardly-directed movement along a screw-path, said self-opener having an inner side comprising at least one traversing web at an upper edge of said self-opener, said at least one traversing web fitting between spaces of said two detached cylinder wall segments at said rotary cap, with a wall of said self-opener being between said two detached cylinder wall segments and walls of said spout, said outer side of said self-opener comprising said at least two guide ribs arranged in distribution over a circumference of said self-opener, said at least two guide ribs interacting with said at least two guide webs arranged on said inner side of said spout in distribution over a circumference of said inner side of said spout, so that when said rotary cap rotates, torque from said rotary cap transmits over lateral limiting edges of said two detached cylinder walls to said traversing web and to said self-opener with said at least two guide webs and said spout being formed so that, when rotated, said self-opener initially follows a steep downwardly-directed screw-line and subsequently assumes a purely rotational movement in a horizontal plane.

11. A self-opener closure for composite packagings for container spouts with a film material according to claim 10, wherein lower edges of said two detached cylinder wall segments each form a curved sloping in an axial direction relative to a cylinder of said three free-standing cylinder wall segments.

12. A self-opener closure for composite packagings for container spouts with a film material according to claim 10, wherein said self-opener comprises, at its lower edge, at least one lancing mandrel having a sharp, downwardly projecting tip and comprising a sharp edge at its flank showing in a counter-clockwise circumferential direction when viewed from above.

13. A self-opener closure for composite packagings for container spouts with a film material according to claim 10, wherein lower edges of said at least two detached cylinder wall segments each form a curved sloping in an axial direction relative to a cylinder of said three free-standing cylinder wall segments.

14. A self-opener closure for composite packagings for container spouts with a film material according to claim 10, wherein said at least two guide ribs of said self-opener at an outer wall of said self-opener are each comprised of a horizontal section and an adjoining vertical section, so that a tip of a right angle formed by said horizontal section and said adjoining vertical section is bevelled at an angle of 45° relative to an outer side of legs of said right angle, for forming a guide surface, and with said at least two guide webs of said spout each being comprised of a section extending with a constant inclination at a circumferential wall and an adjoining horizontal section.

15. A self-opener closure for composite packagings for container spouts with a film material, comprising:

a spout mounted on a composite packaging or on a container spout sealed with a film material, said spout having an inner side with at least two guide webs around its inner circumference and having varying inclines;

a rotary cap having a cap lid with three free-standing cylinder wall segments at an inner side of said cap lid, said three free-standing cylinder walls being spaced apart from one another in a circumferential direction; and, a self-opener having a sleeve-shape with said rotary cap and said self-opener being arranged within said spout and being rotatable via said rotary cap, said self-opener having an outer side with at least two guide ribs on said outer side with each guide rib of said at least two guide ribs of said self-opener having a guide surface, so that when said self-opener rotates within said spout, said guide surface of said self-opener is guided by said at least two guide webs of said spout, thereby rotating said spout in a downwardly-directed movement along a screw-path, said self-opener having at an upper edge of an inner side, a star-shaped web having three webs extending radially from a sleeve axis of said self-opener and fitting between spaces of said three free-standing cylinder walls, with a sleeve wall of said self-opener being arranged between said three free-standing cylinder wall segments and a wall of said spout, said outer side of said self-opener comprising said at least two guide ribs arranged in distribution over a circumference of said self-opener, said at least two guide ribs interacting with said at least two guide webs arranged on said inner side of said spout in distribution over a circumference of said inner side of said spout, so that when said rotary cap rotates, torque from said rotary cap transmits over lateral limiting edges of said three free-standing cylinder wall segments to said traversing web and to said self-opener with said at least two guide webs and said spout being formed so that, when rotated, said self-opener initially follows a steep downwardly-directed screwline and subsequently assumes a purely rotational movement in a horizontal plane.

16. A self-opener closure for composite packagings for container spouts with a film material according to claim 15, wherein lower edges of said three free-standing cylinder wall segments each form a curved sloping in an axial direction relative to a cylinder of said three free-standing cylinder wall segments.

17. A self-opener closure for composite packagings for container spouts with a film material according to claim 15, wherein lower edges of said two detached cylinder wall segments each form a curved sloping in an axial direction relative to a cylinder of said three free-standing cylinder wall segments.

18. A self-opener closure for composite packagings for container spouts with a film material according to claim 15, wherein said self-opener comprises, at its lower edge, at least one lancing mandrel having a sharp, downwardly projecting tip and comprising a sharp edge at its flank showing in a counter-clockwise circumferential direction when viewed from above.

19. A self-opener closure for composite packagings for container spouts with a film material according to claim 15, wherein lower edges of said at least two detached cylinder wall segments each form a curved sloping in an axial direction relative to a cylinder of said three free-standing cylinder wall segments.

20. A self-opener closure for composite packagings for container spouts with a film material according to claim 15, wherein said at least two guide ribs of said self-opener at an outer wall of said self-opener are each comprised of a horizontal section and an adjoining vertical section, so that a tip of a right angle formed by said horizontal section and said adjoining vertical section is bevelled at an angle of 45° relative to an outer side of legs of said right angle, for forming a guide surface, and with said at least two guide webs of said spout each being comprised of a section extending with a constant inclination at a circumferential wall and an adjoining horizontal section.

* * * * *